US012098638B1

(12) United States Patent
Feng et al.

(10) Patent No.: US 12,098,638 B1
(45) Date of Patent: Sep. 24, 2024

(54) METHOD AND SYSTEM FOR COALBED PERMEABILITY-ENHANCEMENT INDUCED BY PRESSURE-RELIEF WITH MINING A EXTREMELY THIN SLICE

(71) Applicant: Taiyuan University of Technology, Taiyuan (CN)

(72) Inventors: Zijun Feng, Taiyuan (CN); Guo Xu, Taiyuan (CN); Jinping Zheng, Taiyuan (CN); Zimin Zhang, Taiyuan (CN); Zhengnan Chen, Taiyuan (CN); Peng Zhao, Taiyuan (CN); Chunsheng Deng, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 0 days.

(21) Appl. No.: 18/645,556

(22) Filed: Apr. 25, 2024

(30) Foreign Application Priority Data

Nov. 23, 2023 (CN) ..... 202311574441.8

(51) Int. Cl.
*E21C 41/16* (2006.01)
*E21C 41/18* (2006.01)

(52) U.S. Cl.
CPC ..... *E21C 41/18* (2013.01)

(58) Field of Classification Search
CPC . E21C 41/18; E21C 41/16; E21D 9/14; E21F 7/00
See application file for complete search history.

(56) References Cited

U.S. PATENT DOCUMENTS

2017/0370156 A1* 12/2017 Lin ..... E21B 7/18
2023/0258083 A1* 8/2023 Wang ..... E21F 16/00 299/12
2023/0340878 A1* 10/2023 Guo ..... E21D 20/00

FOREIGN PATENT DOCUMENTS

| | | | |
|---|---|---|---|
| CN | 104018874 | * | 9/2014 |
| CN | 105952492 | * | 9/2018 |
| CN | 108894813 | * | 4/2020 |
| CN | 115653671 | * | 1/2023 |
| CN | 116556921 | * | 8/2023 |

* cited by examiner

*Primary Examiner* — Carib A Oquendo
(74) *Attorney, Agent, or Firm* — Maine Cernota & Curran

(57) ABSTRACT

Provided is a method and system for coalbed permeability-enhancement induced by pressure-relief with mining an extremely thin slice, belonging to the technical field of coalbed permeability-enhancement induced by pressure-relief. The method includes arranging a boundary gateway and a boundary roadway along a mine field boundary, constructing a row of boreholes into the coal seam to run through a conventional development roadway and the boundary roadway, and arranging devices in the conventional development roadway, the boundary roadway, and the row of boreholes to cut the extremely thin stratified coal seam between boreholes, thus creating a mining space in the coal seam, which causes a deformation failure of the coal around the boreholes.

20 Claims, 13 Drawing Sheets

METHOD AND SYSTEM FOR COALBED PERMEABILITY-ENHANCEMENT INDUCED BY PRESSURE-RELIEF WITH MINING A EXTREMELY THIN SLICE

RELATED APPLICATIONS

This patent application claims the benefit and priority of Chinese Patent Application No. 202311574441.8 filed with the China National Intellectual Property Administration on Nov. 23, 2023, the disclosure of which is incorporated by reference herein in its entirety for all purposes as part of the present application.

FIELD OF THE INVENTION

The present disclosure belongs to the technical field of coalbed permeability-enhancement induced by pressure-relief, and in particular to a method and system for coalbed permeability-enhancement induced by pressure-relief with mining a extremely thin slice.

BACKGROUND OF THE INVENTION

With the increase of mining depth of coal resources in China, the influence of ground stress on the coal seam is getting more and more serious, the gas permeability of the coal seam is getting worse, and the gas pressure increases significantly, leading to a significant increase in the probability of coal and gas outburst in coal mines. Meanwhile, the efficiency of gas extraction is greatly affected, which seriously restricts the safe and efficient production activities of coal mines. Therefore, how to effectively release pressure of the coal seam and enhance the permeability of the coal seam is an important problem.

At present, the commonly used methods for coalbed permeability-enhancement induced by pressure-relief include dense drilling, protective layer mining, hydraulic fracturing, water jet technology, etc. These methods can achieve some results under certain conditions, but there are also some shortcomings. For example, in the dense drilling, the single borehole is small in pressure relief range, if a large-scale pressure relief is required, more boreholes need to be drilled, leading to large work amount, poor continuity and low gas extraction efficiency, and this method is difficult to adapt to the changes of complex gas conditions underground. The method for mining protective layer requires the coal seam to have a protective layer, which is restricted by strict geological conditions and is not universal, and also increases the work amount and is cumbersome to operate. Although the hydraulic fracturing is widely used, but the roof and floor of the coal seam are easily damaged, and the hydraulic fracture produced is single in shape and affected by geo-stress. The water jet technology includes hydraulic punching, hydraulic cutting, hydraulic loosening, water jet reaming, water jet slotting, etc. In such a method, the high-pressure water jet is to break coal using high-pressure water jet, so as to form a free space between coal seams to achieve the effect of pressure relief and permeability enhancement, although good results have been achieved, there are still defects such as incomplete technical equipment and huge underground work amount.

SUMMARY OF THE INVENTION

In order to overcome the disadvantages in the prior art, a method and system for coalbed permeability-enhancement induced by pressure-relief with mining a extremely thin slice are provided. The problems of small pressure relief and permeability enhancement range, low universality, poor continuity, great influence on wall rock and high potential safety hazard in the existing method are solved.

To achieve the objective above, the technical solution adopted by the present disclosure is achieved as follows:

A system for coalbed permeability-enhancement induced by pressure-relief with mining a extremely thin slice includes a conventional development roadway arranged in a mine field, wherein a boundary roadway is arranged along a mine field boundary oriented in a direction that is consistent with a direction of the conventional development roadway, and a designed first mining district is located between the conventional development roadway and the boundary roadway; in the designed first mining district, a row of boreholes is constructed from the conventional development roadway to the boundary roadway; one of two adjacent boreholes of the row of boreholes is used as a slag discharge hole, and another one of the two adjacent boreholes is used as a guide hole; an extremely thin slicing cutting device is arranged in the boundary roadway, and the extremely thin slicing cutting device is located between the slag discharge hole and the guide hole, and the extremely thin slicing cutting device is moved from the boundary roadway to the conventional development roadway for cutting a coal seam.

Further, a scraper guide chain is laid in the slag discharge hole, a leading chain is laid in the guide hole, and a power device is arranged in the conventional development roadway to provide power for the scraper guide chain and the leading chain; and the extremely thin slicing cutting device is moved under traction of the scraper guide chain and the leading chain.

Furthermore, the scraper guide chain is formed by assembling an arc scraper on a guide chain, one end of the scraper guide chain is connected to a fixed rod on the power device, and another end of the scraper guide chain is connected to a rotating drum on the power device; one end of the leading chain is connected to the fixed rod on the power device, and another end of the leading chain is connected to the rotating drum on the power device; the scraper guide chain is in transmission engagement with a gear at one end of the extremely thin slicing cutting device, and the leading chain is in transmission engagement with a gear at another end of the extremely thin slicing cutting device.

Further, both ends of the conventional development roadway intersect with the mine field boundary, a boundary haulage gateway and a boundary return airway are respectively excavated at the both ends of the conventional development roadway, along the mine field boundary; the boundary roadway is excavated when the boundary haulage gateway and the boundary return airway are excavated to another mine field boundary.

Further, for a thin coal seam with a coal thickness of 0.6-1.3 m or a medium-thick coal seam with a coal thickness of 1.3-3.5 m, the boreholes are arranged in one row, and the row of the boreholes is located in an area from a middle to a lower part of a roadway in a height direction of the roadway; for a thick coal seam with a coal thickness greater than 3.5 m, the boreholes are arranged in two rows, and the two rows of the boreholes are respectively located in an upper part and an area from the middle to the lower part of the roadway in the height direction of the roadway; a coal wall within an area where the boreholes are arranged is supported by separate placed mesh, and the placed mesh is connected to a surrounding anchor mesh by iron wires.

Furthermore, a diameter d of each of the boreholes is less than or equal to 0.6 m, and a spacing L between the two adjacent boreholes is more than or equal to 2d+0.5.

A method for coalbed permeability-enhancement induced by pressure-relief implemented by the system for coalbed permeability-enhancement induced by pressure-relief with mining a extremely thin slice includes the following steps:

1) mounting the extremely thin slicing cutting device on a coal wall in the boundary roadway between the slag discharge hole and the guide hole; laying a scraper guide chain in the slag discharge hole, and laying a leading chain in the guide hole; moving the extremely thin slicing cutting device to the conventional development roadway under traction of the scraper guide chain and the leading chain;
2) enabling the extremely thin slicing cutting device to cut the coal seam between the slag discharge hole and the guide hole in a moving process, and pushing broken coal into the scraper guide chain and then discharging the broken coal through the slag discharge hole; forming a mining space after the coal seam between the slag discharge hole and the guide hole is mined, causing deformation failure of a surrounding coal seam;
3) repeating Step 1) and Step 2) in other area outside the designed first mining district to achieve pressure relief and permeability enhancement in the whole mine field.

Preferably, during a borehole construction of the boreholes, a hole protection layer is formed around the boreholes by means of a mud protection process.

Preferably, a boundary haulage gateway and a boundary return airway are respectively excavated at both ends, adjacent to the mine field boundary, of the conventional development roadway, along the mine field boundary; the boundary roadway is excavated from both ends of the boundary roadway to a middle part of the boundary roadway when the boundary haulage gateway and the boundary return airway are excavated to another mine field boundary.

Preferably, the extremely thin slicing refers to a layer of sliced coal seam with a thickness H less than or equal to 0.6 m artificially selected in the coalbed, and the coalbed refers to a coal seam with a normal natural occurrence thickness; the method for coalbed permeability-enhancement induced by pressure-relief is used in any of three stages of mine field development, and the three stages comprise a development stage, a preparation stage and a mining stage; when the designed first mining district is located at the mine field boundary, a construction of the boreholes is implemented from an area of a first mining face in a direction far away from the first mining face.

Compared with the prior art, the present disclosure obtains the following beneficial technical effects:

A boundary roadway is particularly arranged along the mine field boundary, which is dedicated to the transportation and arrangement of cutting devices. A boundary haulage gateway and a boundary return airway are arranged along two mine field boundaries adjacent to the mine field boundary where the boundary roadway is located, and the two gateways form a complete mining system together with the conventional development roadway and the boundary roadway. A row of boreholes are constructed into the coal seam, and a leading chain and a scraper chain are arranged in the boreholes. The extremely thin sliced coal seam between two adjacent parallel boreholes is cut to form a free space in the coalbed, the cracks in the coalbed are extended, so as to achieve large-scale continuous pressure relief and permeability enhancement. Compared with the prior art, the present disclosure has the advantages of large pressure relief and permeability enhancement range, strong continuity, high universality, simple operation, and no influence of ground stress.

The present disclosure is applicable to the permeability enhancement and pressure relief of the coal seam with high pressure and low permeability, especially coal seams in high gas and mine with a gas outcrop and coal seams used for CO2 storage. Meanwhile, the present disclosure can provide reference for improving the injectability of a CO2 sequestration target coal seam.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DEFINITIONS OF ITEM NUMBERS IN THE DRAWINGS

1 conventional development roadway;
2 boundary haulage gateway;
3 boundary return airway;
4 boundary roadway;
5 designed first mining district;
6 borehole;
7 slag discharge hole;
8 guide hole;

9 extremely thin slicing cutting device;
10 scraper guide chain;
11 guide chain;
12 power device;
13 upper row of boreholes;
14 lower row of borehole;
15 coal seam roof;
16 coal seam floor;
17 caving and breaking zone;
18 downward promotion pressure relief area;
19 upward promotion pressure relief area.

DETAILED DESCRIPTION

In order to make the technical problem to be solved by the present disclosure, technical solutions and beneficial effects of the present disclosure more clearly, the present disclosure is further described in detail below with reference to the accompanying drawings and embodiments. It should be understood that specific embodiments described here are only used to illustrate rather than limiting the present disclosure. The technical solution of the present disclosure is described in detail below in conjunction with the embodiments and the accompanying drawings, but the scope of protection is not limited thereto.

Embodiment 1

Figure 1:
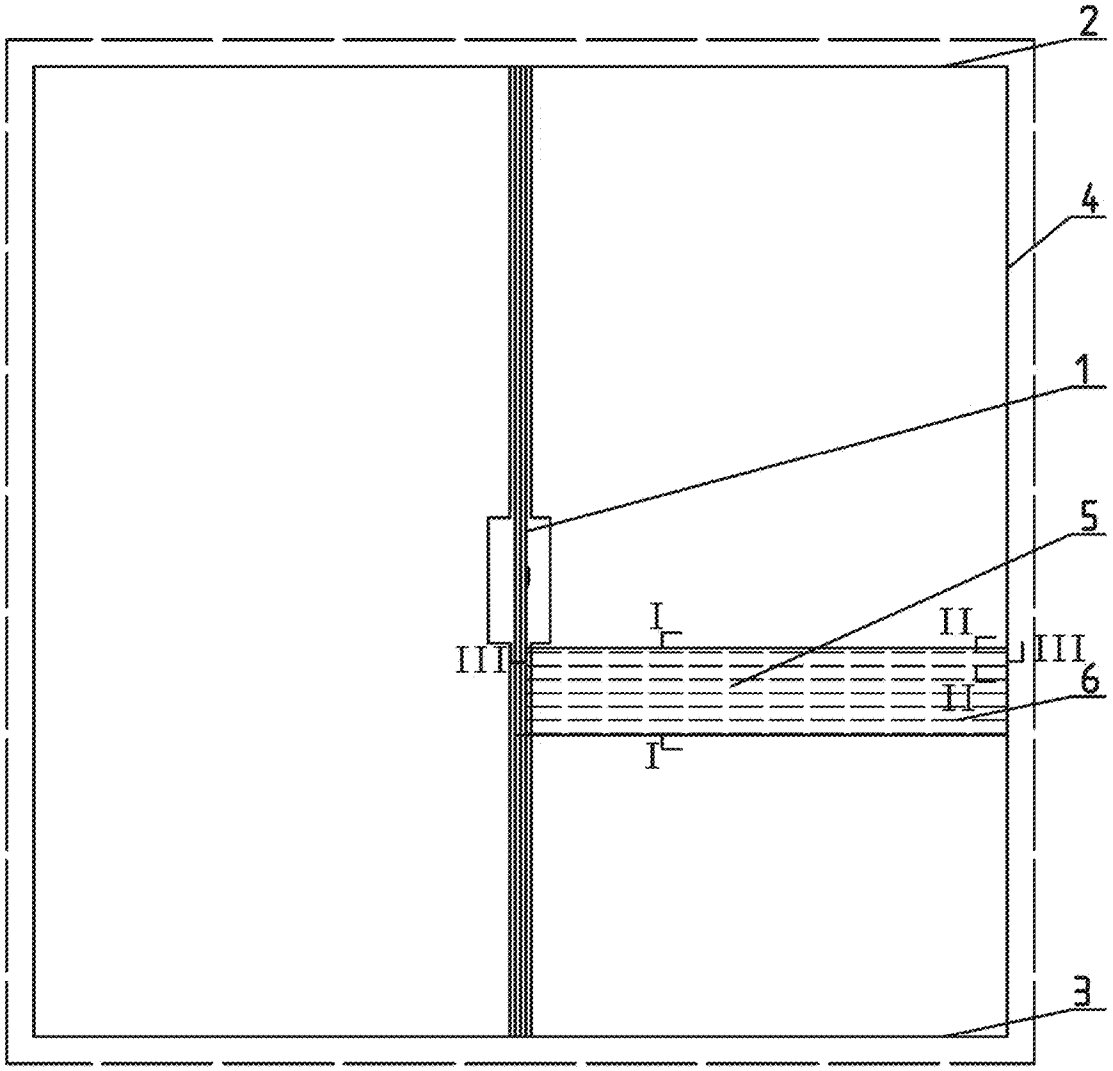
FIG. 1 is a process layout diagram of a method for coalbed permeability-enhancement induced by pressure-relief with mining a extremely thin slice according to the present disclosure.
Figure 2:
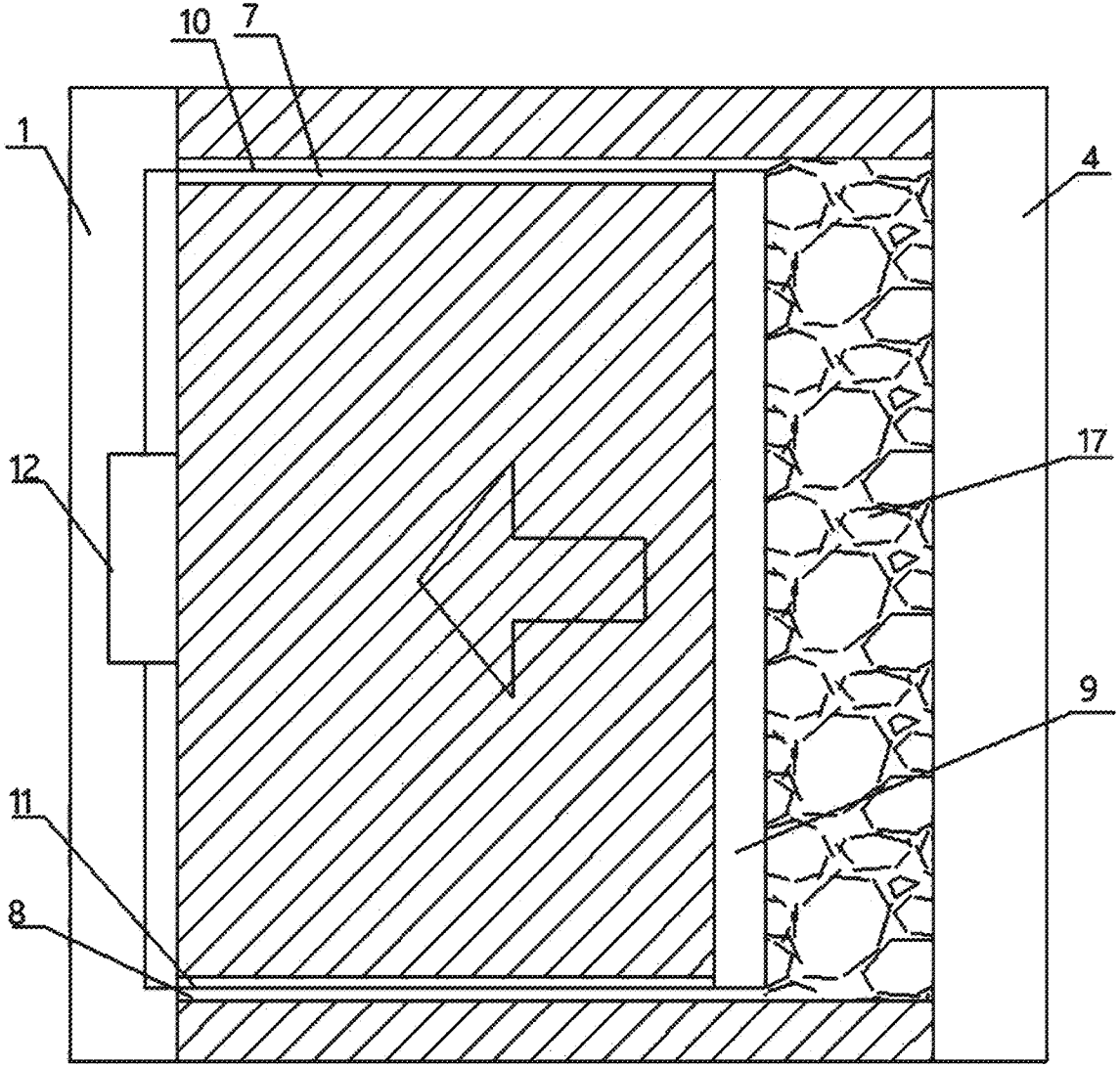
FIG. 2 is a layout top view of a system for coalbed permeability-enhancement induced by pressure-relief with mining a extremely thin slice according to the present disclosure.
Figure 3:
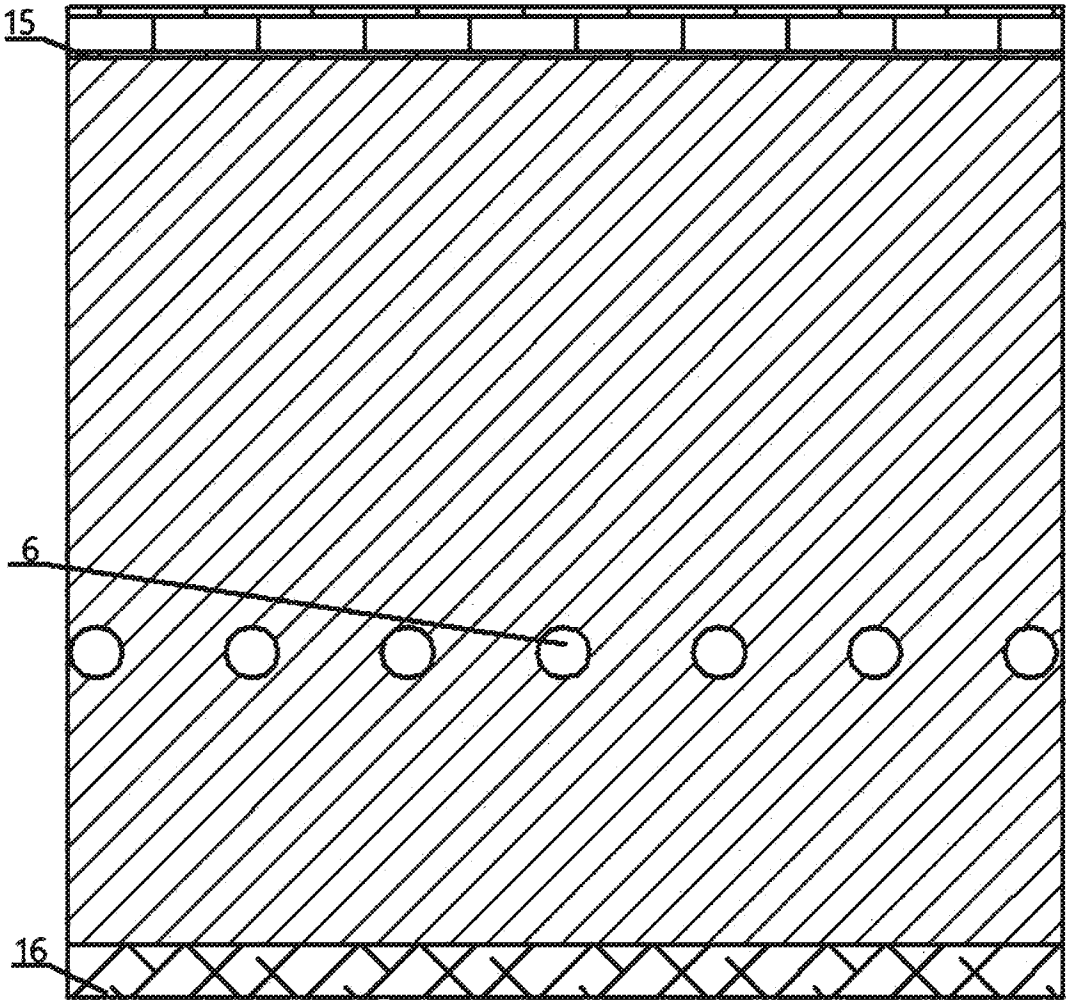
FIG. 3 is an I-I sectional diagram of FIG. 1, i.e., a layout process diagram of a row of boreholes.
Figure 4:
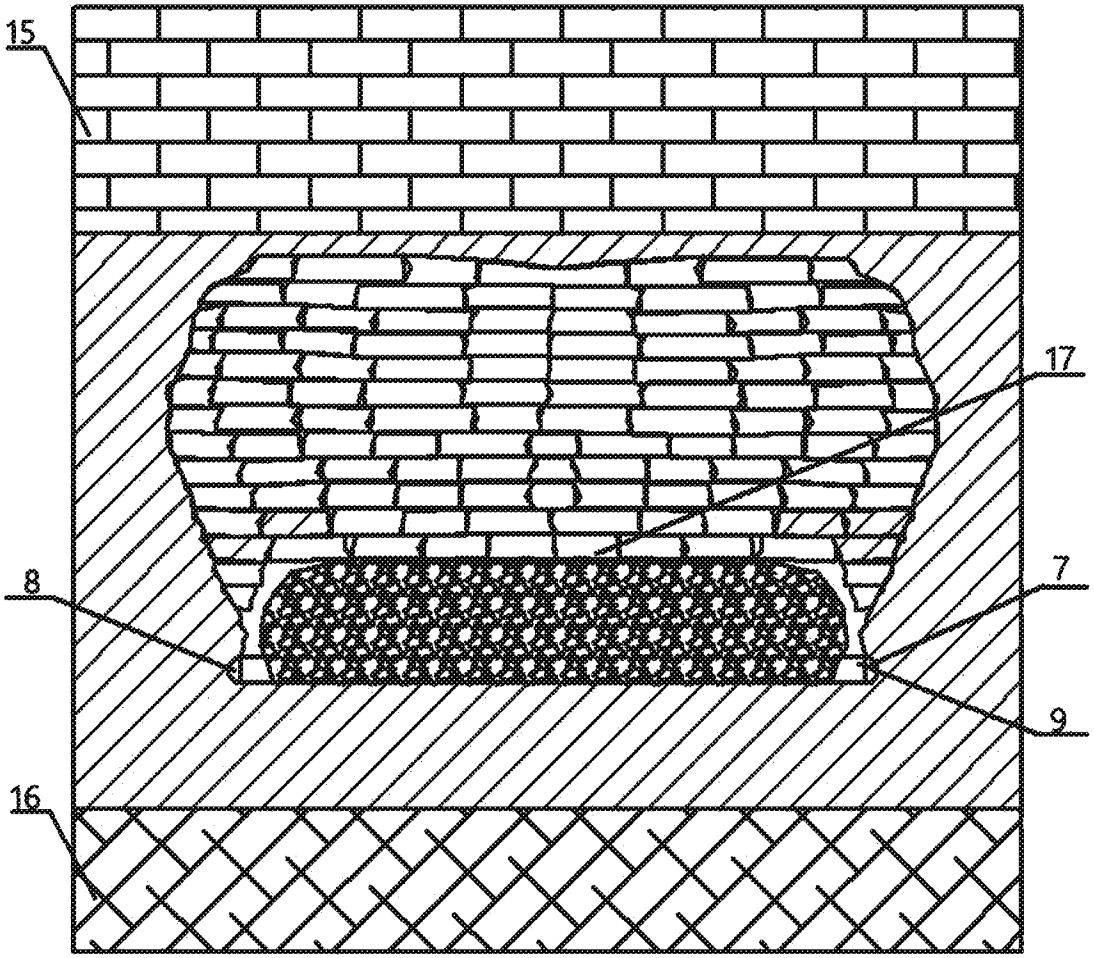
FIG. 4 is a sectional diagram of a position between two adjacent boreholes in FIG. 1.
Figure 5:
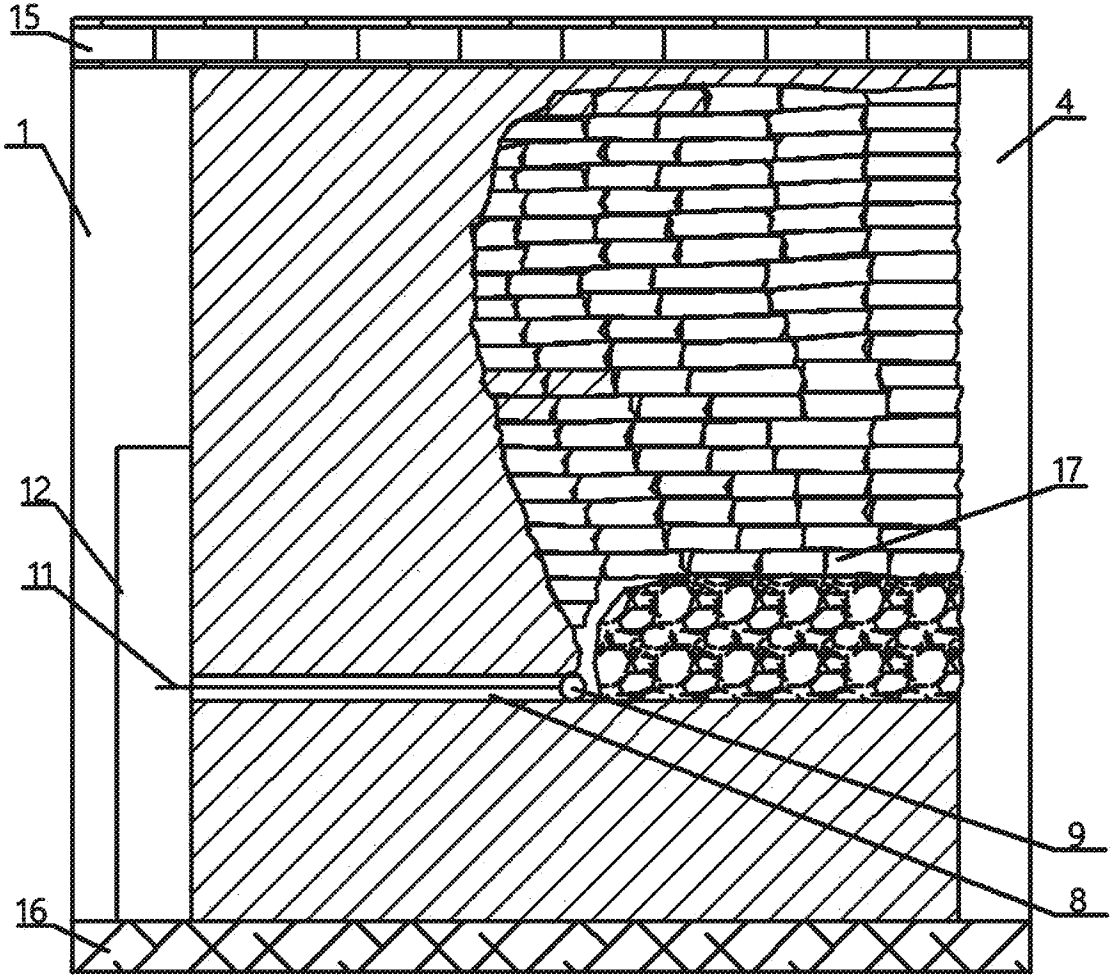
FIG. 5 is a III-III sectional diagram of FIG. 1.
Figure 6:
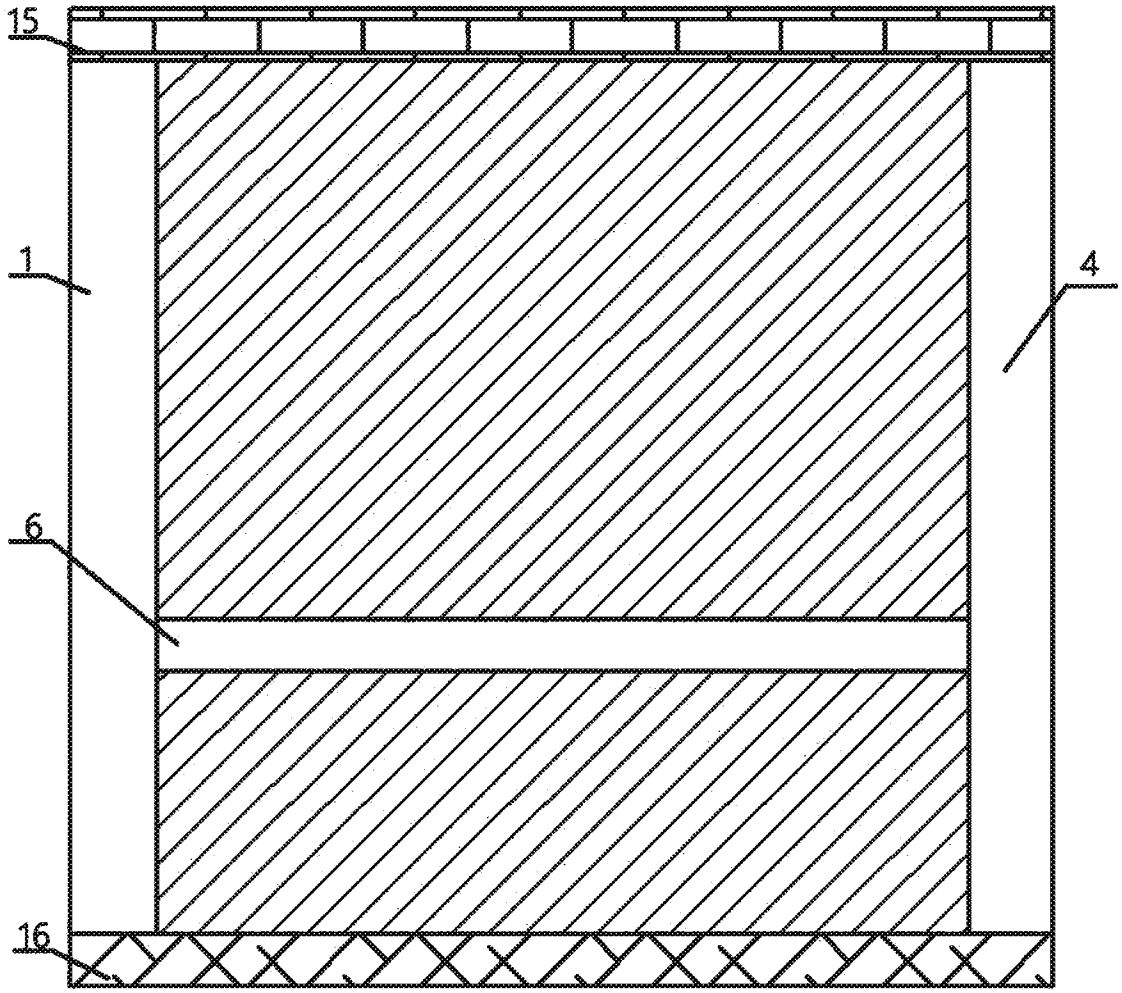
FIG. 6 is a sectional diagram of a layout process of a single row of boreholes.
Figure 7:
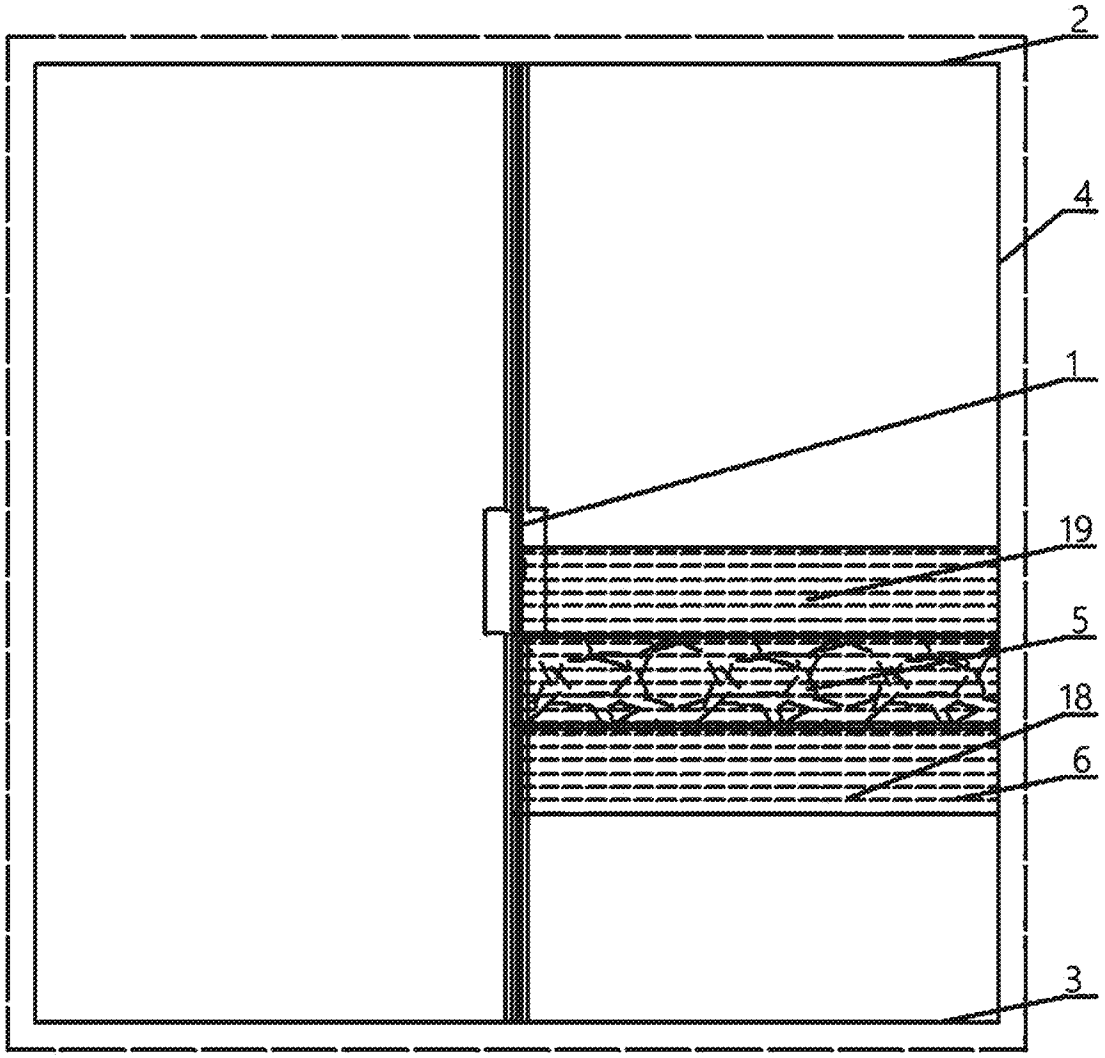
FIG. 7 is a process layout diagram of subsequent promotion when a designed first mining district is located in the middle part of a mine field in a development stage.

As shown in FIG. 1, FIG. 2, FIG. 3, FIG. 4, FIG. 5, FIG. 6 and FIG. 7, a method and system for coalbed permeability-enhancement induced by pressure-relief with mining a extremely thin slice in a development stage are provided. The coalbed refers to a coal seam with a normal natural occurrence thickness, and the extremely thin slicing refers to a layer of coal with a thickness H less than or equal 0.6 m artificially selected in the coalbed.

In this embodiment, a coal seam thickness of the coalbed is 1.2 m, a conventional development roadway 1 is located in the middle of a mine field, and a designed first mining district 5 of the coal seam is located in the middle of the mine field. In the development stage of the coal seam mining, a boundary haulage gateway 2 and a boundary return airway 3 are respectively excavated at both ends, adjacent to a mine field boundary, of the conventional development roadway 1, along the mine field boundary, and a boundary roadway 4 is excavated from both ends of the boundary roadway to a middle part of the boundary roadway when the boundary haulage gateway 2 and the boundary return airway 3 are excavated to another mine field boundary. One side of a coal wall of the boundary roadway 4 is supported by separate placed mesh, and the placed mesh is connected to a surrounding anchor mesh by iron wires. Within the area of the designed first mining district 5, in the conventional development roadway 1, a row of boreholes 6 is constructed from a lower middle position of a coal wall of the roadway to a direction of the boundary roadway 4, and a hole wall is supported by a mud protection process. The boreholes 6 are arranged in one row, each borehole has a diameter of 0.1 m. Two adjacent boreholes 6 are selected, where a spacing between the two boreholes 6 is 20 m, one borehole is used as a slag discharge hole 7, and the other borehole is used as a guide hole 8. In the boundary roadway 4, the placed mesh at a cutting region of the coal wall in the boundary roadway 4 is removed, and a mounting support is arranged. An extremely thin slicing cutting device 9 is mounted on one side of the boundary roadway 4, and the extremely thin slicing cutting device 9 is located on a coal wall between the slag discharge hole 7 and the guide hole 8. The extremely thin slicing cutting device 9 may be a long spiroid hob with cutting teeth, or a chainsaw with cutting teeth.

A scraper guide chain 10 is laid in the slag discharge hole 7, a leading chain 11 is laid in the guide hole 8. One end of the scraper guide chain 10 is connected to a fixed rod on a power device 12, and the other end of the scraper guide chain 10 is connected to a rotating drum on the power device 12. One end of the leading chain 11 is connected to a fixed rod on the power device 12, and the other end of the leading chain 11 is connected to a rotating drum on the power device 12. The scraper guide chain 10 is in gear transmission engagement with one end of the extremely thin slicing cutting device 9, and the leading chain 11 is in gear transmission engagement with the other end of the extremely thin slicing cutting device 9. A traction force is applied to the extremely thin slicing cutting device 9 through gears at both ends of the extremely thin slicing cutting device 9, and the extremely thin slicing cutting device 9 is moved from the boundary roadway 4 to the conventional development roadway 1 under the traction of the scraper guide chain 10 and the leading chain 11. Under the traction of the scraper guide chain 10 and the leading chain 11, the extremely thin slicing cutting device 9 is moved from the boundary roadway 4 to the conventional development roadway 1. The extremely thin slicing cutting device cuts the coal seam during moving, and automatically pushes the broken coal into the scraper guide chain 10, and then the broken coal is discharged through the slag discharge hole 7. After the coal seam between the slag discharge hole 7 and the guide hole 8 is mined, a large mining space is formed, which causes the deformation failure of the surrounding coal seam, thus achieving the purpose of pressure relief and permeability enhancement. After the coal seams between the selected drill holes 6 have been mined, the above steps are repeated to complete the pressure relief and penetration enhancement of the designed first mining district 5, an upward promotion pressure relief area 19 and a downward promotion pressure relief area 18 in an upwardly and downwardly construction sequence that is continually being rolled out throughout the mine.

After the extremely thin coal seam is mined by the above method, a large mining space is formed in the coal seam, causing the deformation failure of the coal seam around the borehole 6 to form a caving and breaking zone 17, thus safely and efficiently realizing large-scale pressure relief and permeability enhancement of the thin coal seam.

Embodiment 2

Figure 8:
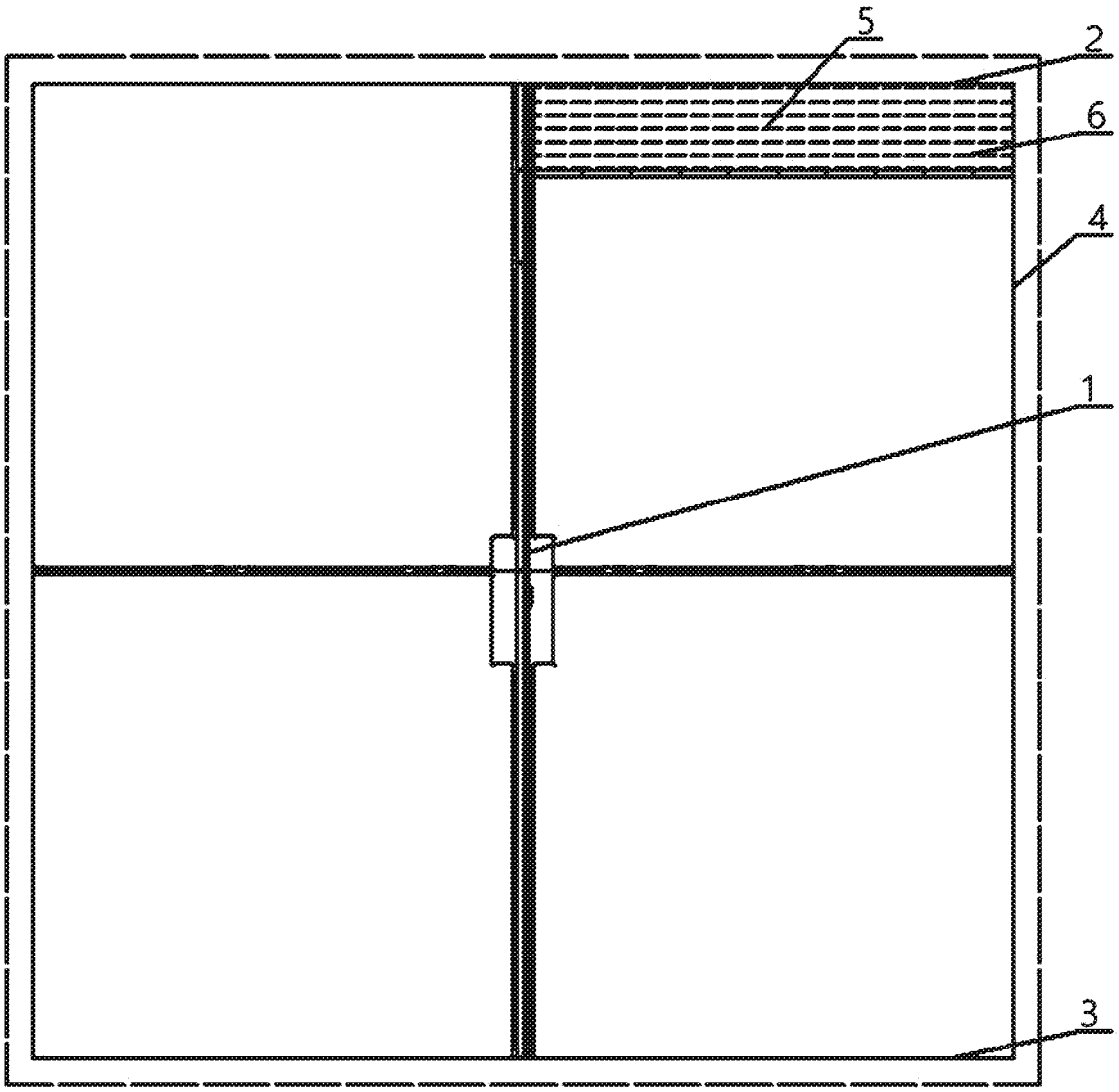
FIG. 8 is a process layout diagram when a designed first mining district is located at a mine field boundary in a mining stage.
Figure 9:
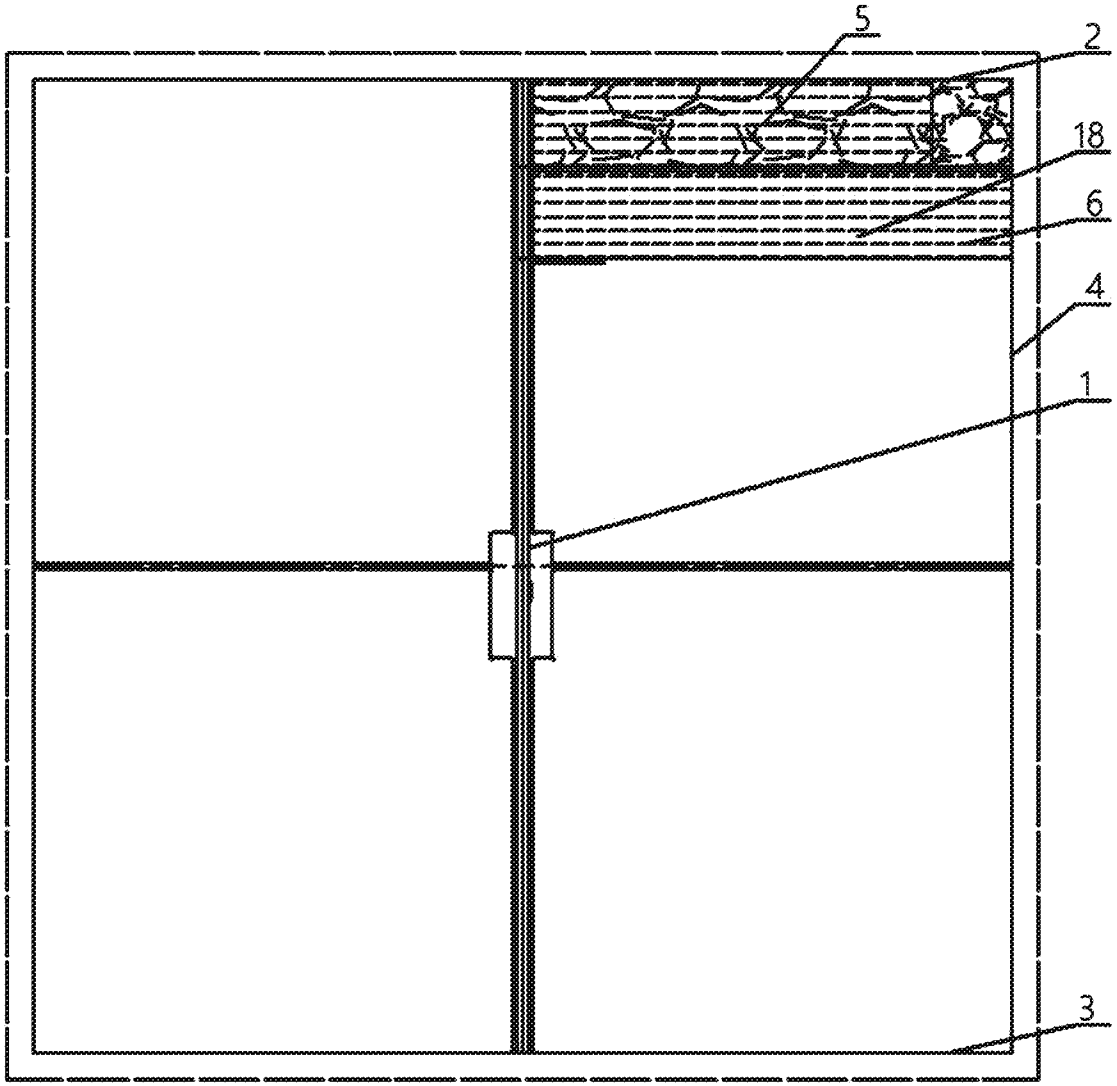
FIG. 9 is a process layout diagram of subsequent promotion when a designed first mining district is located at a mine field boundary in a mining stage.

As shown in FIG. 2, FIG. 3, FIG. 4, FIG. 5, FIG. 6, FIG. 8 and FIG. 9, a method and system for coalbed permeability-enhancement induced by pressure-relief with mining a extremely thin slice in a mining stage are provided. The coalbed refers to a coal seam with a normal natural occurrence thickness, and the extremely thin slicing refers to a layer of coal with a thickness H less than or equal 0.6 m artificially selected in the coal seam.

In this embodiment, the coalbed is a medium-thick coal seam with a thickness of 3.3 m. The conventional development roadway 1 is located in the middle of a mine field, a designed first mining district 5 of the coal seam is located at a mine field boundary. In the mining stage of the coal seam mining, a boundary haulage gateway 2 and a boundary return airway 3 are respectively excavated at both ends, adjacent to the mine field boundary, of the conventional development roadway 1, along the mine field boundary; the boundary roadway 4 is excavated from both ends of the boundary roadway to a middle part of the boundary roadway when the boundary haulage gateway 2 and the boundary return airway 3 are excavated to another mine field boundary. One side of a coal wall of the boundary roadway 4 is supported by separate placed mesh, and the placed mesh is connected to a surrounding anchor mesh by iron wires. Within the area of the designed first mining district 5, in the conventional development roadway 1, a row of boreholes 6 is constructed from a lower middle position of a coal wall of the roadway to a direction of the boundary roadway 4, and a hole wall is supported by a mud protection process. The boreholes 6 are arranged in one row, each borehole has a diameter of 0.2 m. Two adjacent boreholes 6 are selected, where a spacing between the two boreholes 6 is 10 m, one borehole is used as a slag discharge hole 7, and the other borehole is used as a guide hole 8. In the boundary roadway 4, the placed mesh at a cutting region of the coal wall in the boundary roadway 4 is removed, and a mounting support is arranged. An extremely thin slicing cutting device 9 is mounted on one side of the boundary roadway 4, and the extremely thin slicing cutting device 9 is located on a coal wall between the slag discharge hole 7 and the guide hole 8. The extremely thin slicing cutting device 9 may be a long spiroid hob with cutting teeth, or a chainsaw with cutting teeth.

A scraper guide chain 10 is laid in the slag discharge hole 7, a leading chain 11 is laid in the guide hole 8. One end of the scraper guide chain 10 is connected to a fixed rod on a power device 12, and the other end of the scraper guide chain 10 is connected to a rotating drum on the power device 12. One end of the leading chain 11 is connected to a fixed rod on the power device 12, and the other end of the leading chain 11 is connected to a rotating drum on the power device 12. The scraper guide chain 10 is in gear transmission engagement with one end of the extremely thin slicing cutting device 9, and the leading chain 11 is in gear transmission engagement with the other end of the extremely thin slicing cutting device 9. The traction force is applied to the extremely thin slicing cutting device 9 through gears at both ends of the extremely thin layered cutting device 9, and the method for coalbed permeability-enhancement induced by pressure-relief is the same as that in Embodiment 1. After the seams have been cut between the selected boreholes 6, the above steps are repeated to complete the unloading and penetration enhancement of the designed first mining district 5 and the downward promotion pressure relief area 18 in a downward construction sequence that is continually being rolled out throughout the mine.

After the extremely thin coal seam is mined by the above method, a large mining space is formed in the coal seam, causing the deformation failure of the coal seam around the borehole 6 to form a caving and breaking zone 17, thus safely and efficiently realizing large-scale pressure relief and permeability enhancement of the thin coal seam.

Embodiment 3

Figure 10:
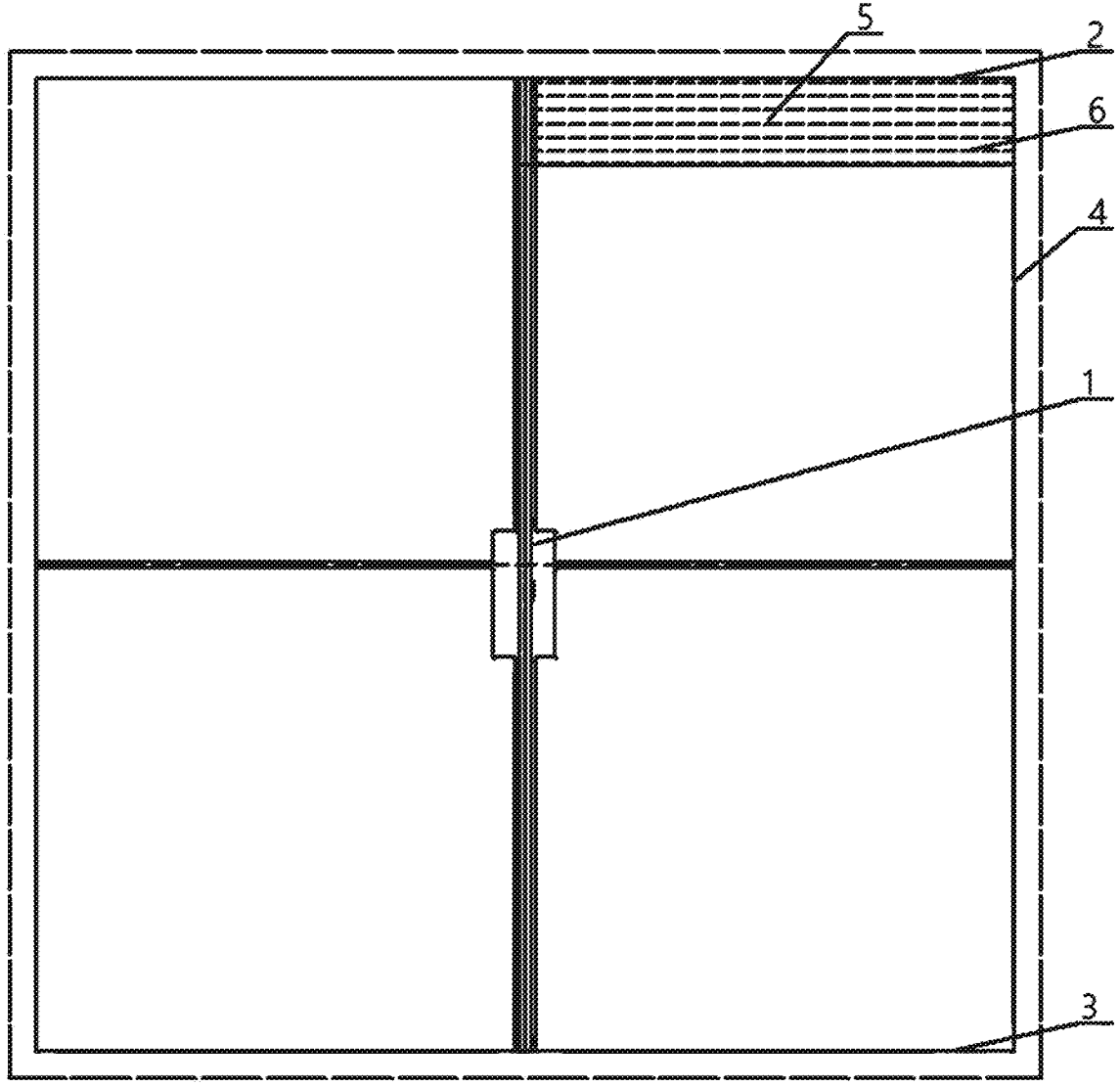
FIG. 10 is a process layout diagram when a designed first mining district is located at a mine field boundary in a preparation stage.
Figure 11:
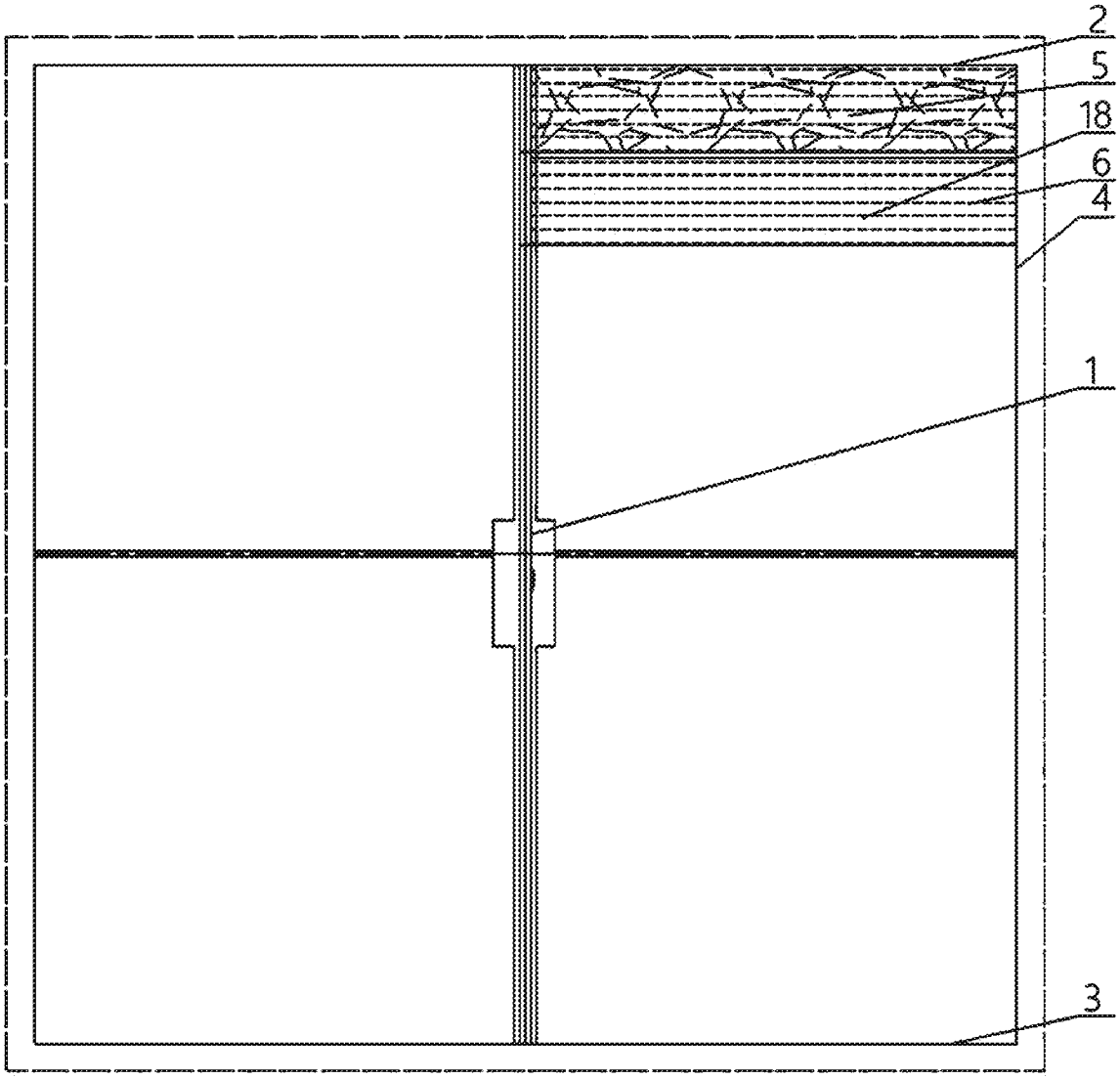
FIG. 11 is a process layout diagram of subsequent promotion when a designed first mining district is located at a mine field boundary in a preparation stage.
Figure 12:
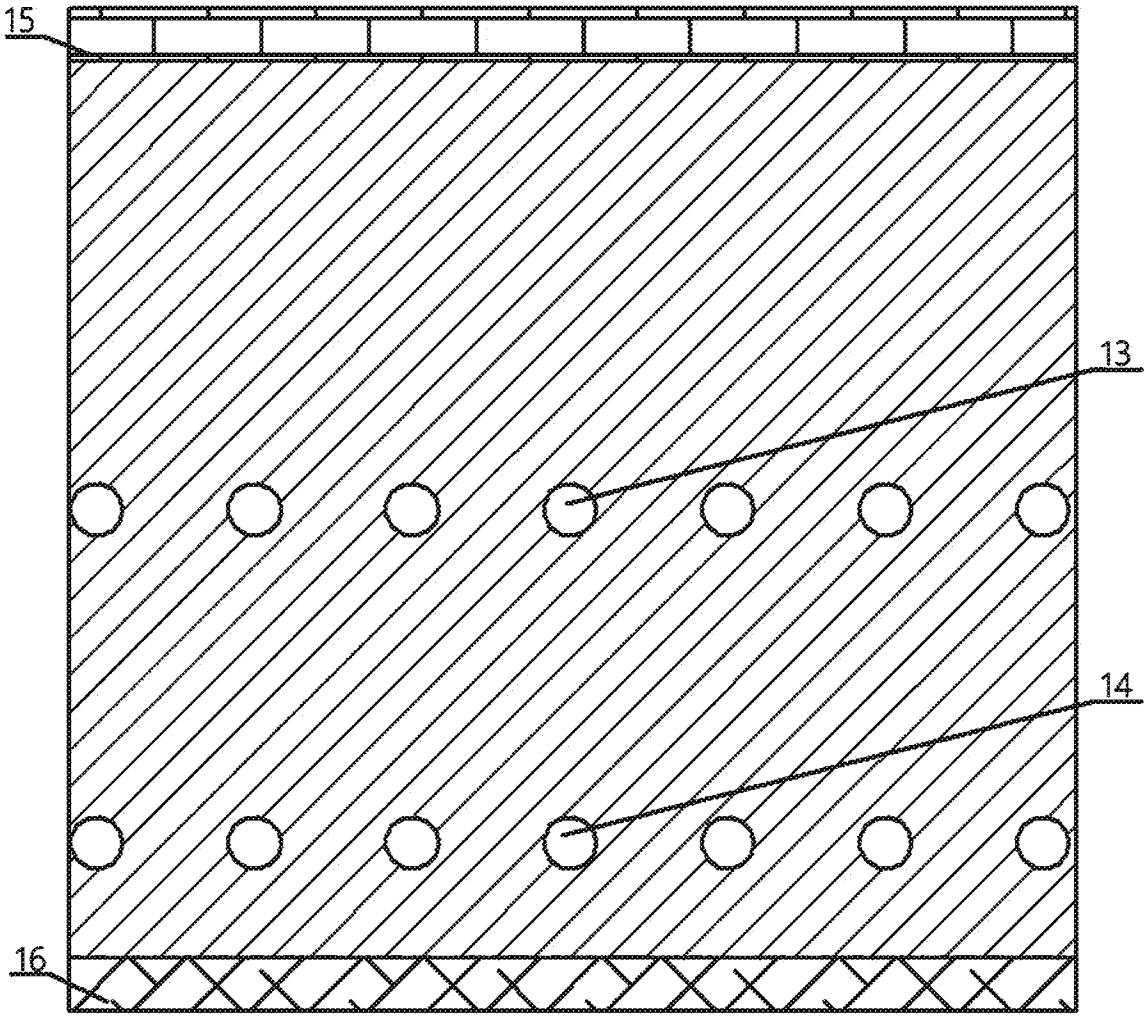
FIG. 12 is a layout process diagram of two rows of boreholes.
Figure 13:
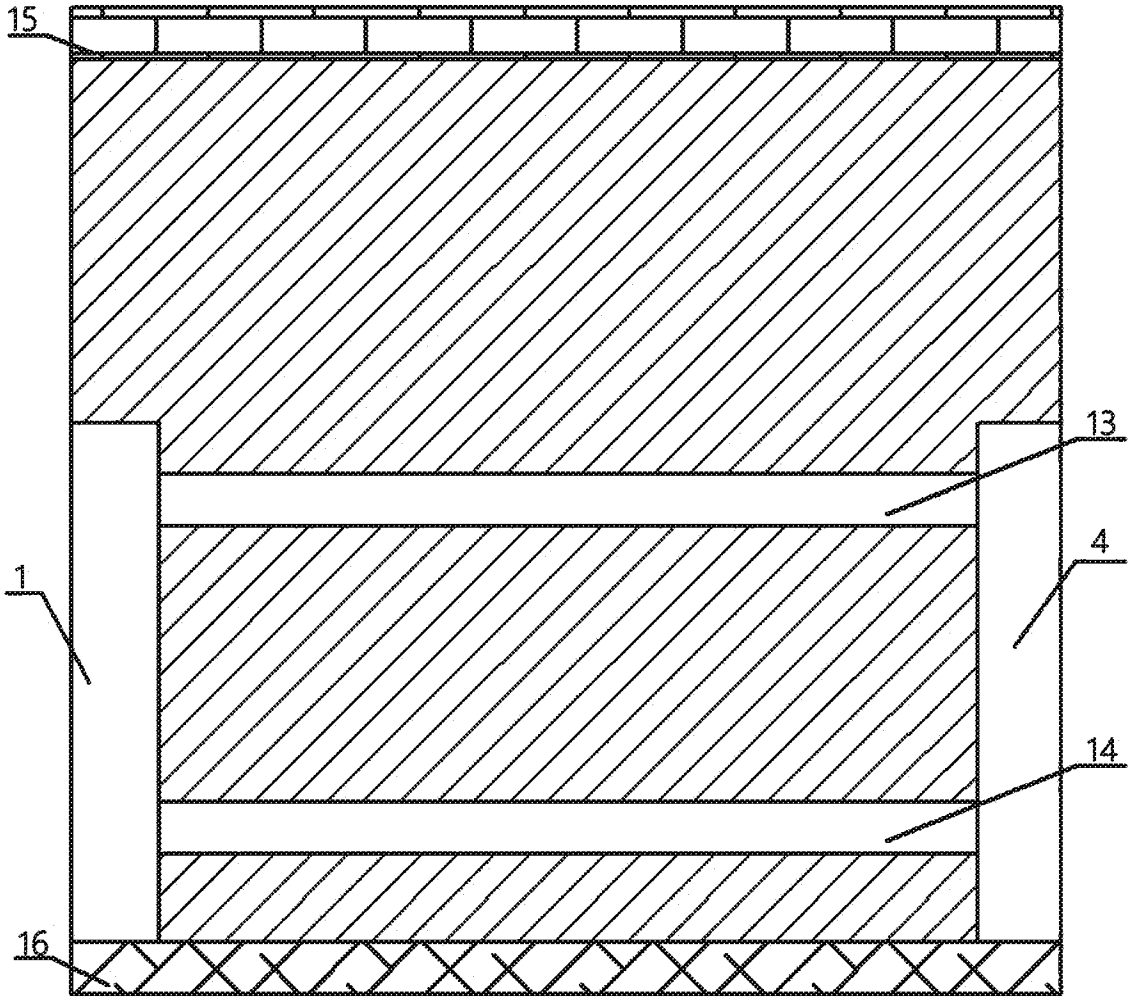
FIG. 13 is a sectional diagram of a layout process of two rows of boreholes.

As shown in FIG. 2, FIG. 4, FIG. 5, FIG. 10, FIG. 11, FIG. 12 and FIG. 13, a method and system for coalbed permeability-enhancement induced by pressure-relief with mining a extremely thin slice in a preparation stage are provided. The coalbed refers to a coal seam with a normal natural occurrence thickness, and the extremely thin slicing refers to a layer of coal with a thickness H less than or equal 0.6 m artificially selected in the coal seam.

In this embodiment, the coalbed is a thick coal seam with a thickness of 7.2 m. The conventional development roadway 1 is located in the middle of a mine field, a designed first mining district 5 of the coal seam is located at a mine field boundary. In the preparation stage of the coal seam mining, a boundary haulage gateway 2 and a boundary return airway 3 are respectively excavated at both ends, adjacent to a mine field boundary, of the conventional development roadway 1, along the mine field boundary; the boundary roadway 4 is excavated from both ends of the boundary roadway to a middle part of the boundary roadway when the boundary haulage gateway 2 and the boundary return airway 3 are excavated to another mine field boundary. One side of a coal wall of the boundary roadway 4 is supported by separate placed mesh, and the placed mesh is connected to a surrounding anchor mesh by iron wires. Within the area of the designed first mining district 5, in the conventional development roadway 1, upper row of boreholes 13 is constructed from a middle position of a coal wall of the roadway to a direction of the boundary roadway 4, lower row of boreholes 14 is constructed from a lower middle position of the coal wall of the roadway to a direction of the boundary roadway 4. Meanwhile, the hole wall is supported using a mud stabilization process, the hole diameter of each borehole of the upper row of borehole 13 and the lower row of borehole 14 is 0.4 m. By using the same method as below, the extremely thin coal seam between boreholes of the upper row of boreholes and between boreholes of the lower row of boreholes 14 is cut. The reason to drill the upper row of boreholes 13 and the lower row of boreholes 14 is that the thickness of the coal seam is too high. At this time, the height of the roadway may only be 0.5-0.7 times the thickness of the coal seam. At this time, the upper row of boreholes 13 need to be arranged in an upper part of the roadway, and the lower row of boreholes 14 need to be arranged in the middle to lower part of the roadway to evenly relieve the pressure of the whole coal seam.

The cutting method is as follows: two adjacent boreholes 6 of the upper row of boreholes 13 located at the mine field boundary are selected, where a spacing between the boreholes 6 is 15 m, one borehole is used as a slag discharge hole 7, and the other borehole is used as a guide hole 8. In the boundary roadway 4, a mounting support is arranged, and an extremely thin slicing cutting device 9 is mounted on the mounting support, and the extremely thin slicing cutting device 9 is located on the coal wall between the slag discharge hole 7 and the guide hole 8, and the extremely thin slicing cutting device 9 may be a long spiroid hob with cutting teeth or a chainsaw with cutting teeth.

The placed mesh at the cutting area on the coal seam in the boundary roadway 4 is removed. A scraper guide chain 10 is laid in the slag discharge hole 7, a leading chain 11 is laid in the guide hole 8. One end of the scraper guide chain 10 is connected to a fixed rod on a power device 12, and the other end of the scraper guide chain 10 is connected to a rotating drum on the power device 12. One end of the leading chain 11 is connected to a fixed rod on the power device 12, and the other end of the leading chain 11 is connected to a rotating drum on the power device 12. The scraper guide chain 10 is in transmission engagement with a gear at one end of the extremely thin slicing cutting device 9, and the leading chain 11 is in transmission engagement with a gear at the other end of the extremely thin slicing cutting device 9. The traction force is applied to the extremely thin slicing cutting device 9 through gears at both ends of the extremely thin slicing cutting equipment 9, and the method for coalbed permeability-enhancement induced by pressure-relief is the same as that in Embodiment 1. The cutting method for an extremely thin coal seam between the lower row of boreholes 14 is the same as that for the extremely thin coal seam between the boreholes of the upper row of boreholes 13.

After the seams have been cut between the selected boreholes 6, the above steps are repeated to complete the unloading and penetration enhancement of the designed first mining district 5 and a downward promotion pressure relief area 18 in a downward construction sequence that is continually being rolled out throughout the mine.

After the extremely thin coal seam is mined by the above method, a large mining space is formed in the coal seam, causing the deformation failure of the coal seam around the borehole 6 to form a caving and breaking zone 17, thus safely and efficiently realizing large-scale pressure relief and permeability enhancement of the thin coal seam.

The above is a further detailed description of the present disclosure in conjunction with specific preferred embodiments, and the specific embodiments of the present disclosure cannot be regarded as limited to thereto. For those of ordinary skill in the art, several simple deductions or substitutions can be made without departing from the present disclosure, which should all be regarded as belonging to the present disclosure, and the patent protection scope is determined by the submitted claims.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the disclosure is not limited to just these forms, but is amenable to various changes and modifications. The present application does not explicitly recite all possible combinations of features that fall within the scope of the disclosure. The features disclosed herein for the various embodiments can generally be interchanged and combined into any combinations that are not self-contradictory without departing from the scope of the disclosure. In particular, the limitations presented in dependent claims below can be combined with their corresponding independent claims in any number and in any order without departing from the scope of this disclosure, unless the dependent claims are logically incompatible with each other.

What is claimed is:

1. A system for coalbed permeability-enhancement induced by pressure-relief with mining an extremely thin slice, the system comprising:

a conventional development roadway arranged in a mine field;

a boundary roadway arranged along a mine field boundary and oriented in a direction consistent with a direction of the conventional development roadway;

a designed first mining district located between the conventional development roadway and the boundary roadway;

in the designed first mining district, a row of boreholes constructed from the conventional development roadway to the boundary roadway, wherein one of two adjacent boreholes of the row of boreholes is used as a slag discharge hole, and another one of the two adjacent boreholes is used as a guide hole; and an extremely thin slicing cutting device arranged in the boundary roadway, the extremely thin slicing cutting device being located between the slag discharge hole and the guide hole, and the extremely thin slicing cutting device being movable from the boundary roadway to the conventional development roadway for cutting a coal seam.

2. The system for coalbed permeability-enhancement induced by pressure-relief with mining an extremely thin slice according to claim 1, wherein:

a scraper guide chain is laid in the slag discharge hole, a leading chain is laid in the guide hole, and a power device is arranged in the conventional development roadway to provide power for the scraper guide chain and the leading chain; and the extremely thin slicing cutting device is movable under traction of the scraper guide chain and the leading chain.

3. The system for coalbed permeability-enhancement induced by pressure-relief with mining an extremely thin slice according to claim 2, wherein:

the scraper guide chain is formed by assembling an arc scraper on a guide chain, one end of the scraper guide chain being connected to a fixed rod on the power device, and another end of the scraper guide chain being connected to a rotating drum on the power device;

one end of the leading chain is connected to the fixed rod on the power device, and another end of the leading chain is connected to the rotating drum on the power device;

the scraper guide chain is in transmission engagement with a gear at one end of the extremely thin slicing cutting device; and the leading chain is in transmission engagement with a gear at another end of the extremely thin slicing cutting device.

4. The system for coalbed permeability-enhancement induced by pressure-relief with mining an extremely thin slice according to claim 1, wherein:

both ends of the conventional development roadway intersect with the mine field boundary;

a boundary haulage gateway and a boundary return airway are respectively excavated at the both ends of the conventional development roadway, along the mine field boundary; and the boundary roadway is excavated when the boundary haulage gateway and the boundary return airway are excavated to another mine field boundary.

5. The system for coalbed permeability-enhancement induced by pressure-relief with mining an extremely thin slice according to claim 1, wherein:

for a thin coal seam with a coal thickness of 0.6-1.3 m or a medium-thick coal seam with a coal thickness of 1.3-3.5 m, the boreholes are arranged in one row, and the row of the boreholes are located in an area from a middle to a lower part of a roadway in a height direction of the roadway;

for a thick coal seam with a coal thickness greater than 3.5 m, the boreholes are arranged in two rows, and the two rows of the boreholes are respectively located in an upper part and an area from the middle to the lower part of the roadway in the height direction of the roadway; and a coal wall within an area where the boreholes are arranged is supported by separate placed mesh, the placed mesh being connected to a surrounding anchor mesh by iron wires.

6. The system for coalbed permeability-enhancement induced by pressure-relief with mining an extremely thin slice according to claim 5, wherein a diameter d of each of the boreholes is less than or equal to 0.6 m, and a spacing L between the two adjacent boreholes is more than or equal to 2d+0.5 m.

7. A method of coalbed permeability-enhancement induced by pressure-relief implemented by the system for coalbed permeability-enhancement induced by pressure-relief with mining an extremely thin slice, the method comprising:

1) providing a system for coalbed permeability-enhancement induced by pressure-relief with mining an extremely thin slice according to claim 2;
2) mounting the extremely thin slicing cutting device on a coal wall in the boundary roadway between the slag discharge hole and the guide hole;
3) laying the scraper guide chain in the slag discharge hole, and laying the leading chain in the guide hole;
4) Moving the extremely thin slicing cutting device to the conventional development roadway under the traction of the scraper guide chain and the leading chain;
5) enabling the extremely thin slicing cutting device to cut the coal seam between the slag discharge hole and the guide hole in a moving process, while pushing broken coal into the scraper guide chain and then discharging the broken coal through the slag discharge hole;
6) forming a mining space after the coal seam between the slag discharge hole and the guide hole is mined, causing deformation failure of a surrounding coal seam; and
7) Repeating steps 2) through 6) in another area that is outside of the designed first mining district to achieve pressure relief and permeability enhancement in the whole mine field.

8. The method of coalbed permeability-enhancement induced by pressure-relief implemented by the system for coalbed permeability-enhancement induced by pressure-relief with mining an extremely thin slice according to claim 7, wherein during a borehole construction of the boreholes, a hole protection layer is formed around the boreholes by a mud protection process.

9. The method of coalbed permeability-enhancement induced by pressure-relief implemented by the system for coalbed permeability-enhancement induced by pressure-relief with mining an extremely thin slice according to claim 7, wherein a boundary haulage gateway and a boundary return airway are respectively excavated at both ends, adjacent to the mine field boundary, of the conventional development roadway, along the mine field boundary, the boundary roadway being excavated in opposite directions when the boundary haulage gateway and the boundary return airway are excavated to another mine field boundary.

10. The method of coalbed permeability-enhancement induced by pressure-relief implemented by the system for coalbed permeability-enhancement induced by pressure-relief with mining an extremely thin slice according to claim 7, wherein:

the extremely thin slicing refers to a layer of sliced coal seam having a thickness H that is less than or equal to 0.6 m artificially selected in the coalbed, and the coalbed is a coal seam having a normal natural occurrence thickness;

the method of coalbed permeability-enhancement induced by pressure-relief is used in any of three stages of mine field development, the three stages comprising a development stage, a preparation stage and a mining stage; and when the designed first mining district is located at the mine field boundary, a construction of the boreholes is implemented from an area of a first mining face in a direction far away from the first mining face.

11. A method of coalbed permeability-enhancement induced by pressure-relief implemented by the system for coalbed permeability-enhancement induced by pressure-relief with mining an extremely thin slice, the method comprising:

1) providing a system for coalbed permeability-enhancement induced by pressure-relief with mining an extremely thin slice according to claim 3;
2) mounting the extremely thin slicing cutting device on a coal wall in the boundary roadway between the slag discharge hole and the guide hole;
3) laying the scraper guide chain in the slag discharge hole, and laying the leading chain in the guide hole;
4) moving the extremely thin slicing cutting device to the conventional development roadway under the traction of the scraper guide chain and the leading chain;
5) enabling the extremely thin slicing cutting device to cut the coal seam between the slag discharge hole and the guide hole in a moving process, while pushing broken coal into the scraper guide chain and then discharging the broken coal through the slag discharge hole;
6) forming a mining space after the coal seam between the slag discharge hole and the guide hole is mined, causing deformation failure of a surrounding coal seam; and
7) Repeating steps 2-6 in another area that is outside of the designed first mining district to achieve pressure relief and permeability enhancement in the whole mine field.

12. The method of coalbed permeability-enhancement induced by pressure-relief implemented by the system for coalbed permeability-enhancement induced by pressure-relief with mining an extremely thin slice according to claim 11, wherein during a borehole construction of the boreholes, a hole protection layer is formed around the boreholes by means of a mud protection process.

13. The method of coalbed permeability-enhancement induced by pressure-relief implemented by the system for coalbed permeability-enhancement induced by pressure-relief with mining an extremely thin slice according to claim 11, wherein a boundary haulage gateway and a boundary return airway are respectively excavated at both ends, adjacent to the mine field boundary, of the conventional development roadway, along the mine field boundary, the boundary roadway being excavated in opposite directions when the boundary haulage gateway and the boundary return airway are excavated to another mine field boundary.

14. The method of coalbed permeability-enhancement induced by pressure-relief implemented by the system for coalbed permeability-enhancement induced by pressure-relief with mining an extremely thin slice according to claim 11, wherein:

the extremely thin slicing refers to a layer of sliced coal seam with a thickness H less than or equal to 0.6 m artificially selected in the coalbed, and the coalbed refers to a coal seam with a normal natural occurrence thickness;

the method of coalbed permeability-enhancement induced by pressure-relief is used in any of three stages of mine field development, the three stages comprising a development stage, a preparation stage and a mining stage; and when the designed first mining district is located at the mine field boundary, a construction of the boreholes is implemented from an area of a first mining face in a direction far away from the first mining face.

15. A method of coalbed permeability-enhancement induced by pressure-relief implemented by the system for coalbed permeability-enhancement induced by pressure-relief with mining an extremely thin slice, the method comprising:

1) providing a system for coalbed permeability-enhancement induced by pressure-relief with mining an extremely thin slice according to claim 4;
2) mounting the extremely thin slicing cutting device on a coal wall in the boundary roadway between the slag discharge hole and the guide hole;
3) laying a scraper guide chain in the slag discharge hole, and laying a leading chain in the guide hole;
4) moving the extremely thin slicing cutting device to the conventional development roadway under traction of the scraper guide chain and the leading chain;
5) enabling the extremely thin slicing cutting device to cut the coal seam between the slag discharge hole and the guide hole in a moving process, while pushing broken coal into the scraper guide chain and then discharging the broken coal through the slag discharge hole;
6) forming a mining space after the coal seam between the slag discharge hole and the guide hole is mined, causing deformation failure of a surrounding coal seam; and
7) repeating steps 2-6 in another area that is outside of the designed first mining district to achieve pressure relief and permeability enhancement in the whole mine field.

16. The method of coalbed permeability-enhancement induced by pressure-relief implemented by the system for coalbed permeability-enhancement induced by pressure-relief with mining an extremely thin slice according to claim 15, wherein during a borehole construction of the boreholes, a hole protection layer is formed around the boreholes by means of a mud protection process.

17. A method of coalbed permeability-enhancement induced by pressure-relief implemented by the system for coalbed permeability-enhancement induced by pressure-relief with mining an extremely thin slice, the method comprising:

1) providing a system for coalbed permeability-enhancement induced by pressure-relief with mining an extremely thin slice according to claim 5;
2) mounting the extremely thin slicing cutting device on a coal wall in the boundary roadway between the slag discharge hole and the guide hole;
3) laying a scraper guide chain in the slag discharge hole, and laying a leading chain in the guide hole;
4) moving the extremely thin slicing cutting device to the conventional development roadway under traction of the scraper guide chain and the leading chain;
5) enabling the extremely thin slicing cutting device to cut the coal seam between the slag discharge hole and the guide hole in a moving process, while pushing broken coal into the scraper guide chain and then discharging the broken coal through the slag discharge hole;
6) forming a mining space after the coal seam between the slag discharge hole and the guide hole is mined, causing deformation failure of a surrounding coal seam; and
7) repeating steps 2-6 in another area that is outside of the designed first mining district to achieve pressure relief and permeability enhancement in the whole mine field.

18. The method of coalbed permeability-enhancement induced by pressure-relief implemented by the system for coalbed permeability-enhancement induced by pressure-relief with mining an extremely thin slice according to claim 17, wherein during a borehole construction of the boreholes, a hole protection layer is formed around the boreholes by means of a mud protection process.

19. A method of coalbed permeability-enhancement induced by pressure-relief implemented by the system for coalbed permeability-enhancement induced by pressure-relief with mining an extremely thin slice, the method comprising:

1) providing a system for coalbed permeability-enhancement induced by pressure-relief with mining an extremely thin slice according to claim 6;
2) mounting the extremely thin slicing cutting device on a coal wall in the boundary roadway between the slag discharge hole and the guide hole;
3) laying a scraper guide chain in the slag discharge hole, and laying a leading chain in the guide hole;
4) moving the extremely thin slicing cutting device to the conventional development roadway under traction of the scraper guide chain and the leading chain;
5) enabling the extremely thin slicing cutting device to cut the coal seam between the slag discharge hole and the guide hole in a moving process, while pushing broken coal into the scraper guide chain and then discharging the broken coal through the slag discharge hole;
6) forming a mining space after the coal seam between the slag discharge hole and the guide hole is mined, causing deformation failure of a surrounding coal seam; and
7) repeating steps 2-6 in another area that is outside of the designed first mining district to achieve pressure relief and permeability enhancement in the whole mine field.

20. The method of coalbed permeability-enhancement induced by pressure-relief implemented by the system for coalbed permeability-enhancement induced by pressure-relief with mining an extremely thin slice according to claim 19, wherein during a borehole construction of the boreholes, a hole protection layer is formed around the boreholes by means of a mud protection process.

* * * * *